US008807060B2

(12) United States Patent
Parish et al.

(10) Patent No.: US 8,807,060 B2
(45) Date of Patent: Aug. 19, 2014

(54) MOORING LIMB

(76) Inventors: David Parish, Exeter (GB); Lars Johanning, Exeter (GB)

( * ) Notice: Subject to any disclaimer, the term of this patent is extended or adjusted under 35 U.S.C. 154(b) by 0 days.

(21) Appl. No.: 13/522,504

(22) PCT Filed: Jan. 18, 2011

(86) PCT No.: PCT/IB2011/050206

§ 371 (c)(1),
(2), (4) Date: Jul. 17, 2012

(87) PCT Pub. No.: WO2011/089545

PCT Pub. Date: Jul. 28, 2011

(65) Prior Publication Data

US 2012/0298028 A1 Nov. 29, 2012

(30) Foreign Application Priority Data

Jan. 19, 2010 (GB) ..... 1000800.1

(51) Int. Cl.

| | |
|---|---|
| ***F16G 11/00*** | (2006.01) |
| ***B63B 21/20*** | (2006.01) |
| *B63B 21/00* | (2006.01) |

(52) U.S. Cl.

CPC ..... *B63B 21/20* (2013.01); *B63B 2021/005* (2013.01)

USPC ..... 114/215; 114/230.22

(58) Field of Classification Search

USPC ..... 114/215, 230.22

See application file for complete search history.

(56) References Cited

U.S. PATENT DOCUMENTS

| | | | | |
|---|---|---|---|---|
| 2,101,004 | A * | 11/1937 | Fox | 57/225 |
| 3,117,371 | A | 1/1964 | Farley | |
| 4,022,010 | A * | 5/1977 | Gladenbeck et al. | 57/231 |
| 4,258,608 | A * | 3/1981 | Brown | 87/6 |
| 4,640,212 | A | 2/1987 | Brandt | |
| 5,483,911 | A * | 1/1996 | Kubli | 114/230.22 |
| 6,050,077 | A | 4/2000 | Muller | |
| 2009/0189616 | A1 * | 7/2009 | Krutz et al. | 324/548 |

OTHER PUBLICATIONS

EPO Search Report, Jan. 18, 2011.

* cited by examiner

*Primary Examiner* — Stephen Avila

(74) *Attorney, Agent, or Firm* — Crose Law LLC; Bradley D. Crose

(57) ABSTRACT

A mooring limb for damping the oscillations of a moored object comprising an axially extensible outer sheath, and an inner radially compressible core, the core being compressible radially by the sheath as the axial length of the limb increases, the limb being axially contractible as a result of a force provided by the core acting radially outward onto the sheath.

19 Claims, 7 Drawing Sheets

MOORING LIMB

CROSS-REFERENCE TO RELATED APPLICATION

The present non-provisional patent application claims the benefit of priority of: foreign Patent Application No. PCT/IB2011/050206 (International Publication No. WO 2011/089545), which is entitled MOORING LIMB and which was filed 18 Jan. 2011, which is incorporated in full by reference herein.

FIELD OF THE INVENTION

The present invention relates to a mooring limb, a method of mooring an object and a method of making a mooring limb. In particular, although not exclusively, the invention relates to a damping mooring limb.

BACKGROUND OF THE INVENTION

Mooring limbs, legs, tethers, or lines, are required for mooring objects, such as ships, pontoons, and buoys so that they do not move too much relative to the land beneath the surface of the water. To more closely limit the movement of such an object it is known to use more than one limb, possibly at either end of a ship, for instance. Known mooring limbs typically comprise ropes or chains. There are two principal kinds of mooring limbs. The first are taught in use, and the second are slack in use. The present invention may be either taught and/or slack in use.

To allow for the rise and fall of the water level on which a moored object is floating due to, for instance, tides or waves, a certain amount of slack must be provided in the length of a slack-type limb. However, this allows for the object to move "off station" when the water level is lower than the highest level catered for by the slack. Although this is not a problem for most applications, it can cause problems for objects, such as pontoons or wave energy converters, which need to remain substantially "on station" and yet be able to rise and fall with, for instance, the tides.

A known system which overcomes this problem is provided in the form of a resilient limb comprising rubber-type materials. These limbs allow for an extension and contraction of their longitudinal length whilst maintaining tension therein. This allows for the object to rise and fall with the tides, waves and other movements of the water whilst remaining on station.

BRIEF SUMMARY OF THE INVENTION

The present invention provides an alternative system for mooring substantially floating objects.

In a first aspect, the invention provides a mooring limb comprising an elastically compressible core and an outer sheath, the limb being axially extensible as a result of a tensile force being applied to the sheath, the radial width of the sheath being contractible as the axial length of the limb increases, the core being compressible radially by the sheath as the axial length of the limb increases, the limb being axially contractible as a result of a force provided by the core acting radially outward onto the sheath.

The sheath may be braided, although other types of axially extensible sheaths are contemplated. The sheath may be resilient. This resilience may be achieved by the braiding comprising a criss-cross arrangement of braids in a similar manner to medical stents and braided rope. As the axial length of the limb increases so too does the axial length of the sheath. This may be affected by the braids moving relative to one another. This extension has the effect that the radius of the sheath decreases. Enough contraction of the radius will provide a squeezing force radially inward onto the core. The sheath may be substantially cylindrical in form although the cross-sectional shape is not limited to circular as other cross-sectional shapes are contemplated such as oval, square, rectangular, hexagonal, octagonal, or polygonal. Furthermore, the cross-sectional area and/or shape of the sheath may vary along its axial length. For instance, a substantially circular/spherical or oval shape sheath is contemplated.

With regard to the term "elastically compressible" this may mean that the core is not comprised of water. Rather, materials such as one or more of acrylonitrile butadiene rubber, polyurethane, cork, polymer blends etc. are contemplated for the core. The core may be solid or may be porous.

The core may be substantially cylindrical in form although the cross-sectional shape is not limited to circular as other cross-sectional shapes are contemplated such as oval, square, rectangular, hexagonal, octagonal, or polygonal. Furthermore, the cross-sectional area and/or shape of the core may vary along its axial length, for example, a substantially spherical or oval shape is possible. This may be useful in accommodating differing compressional forces provided axially along the sheath. For instance, greater radially directed compressive forces may be provided by the sheath towards the middle of its axial length compared with towards its axial ends.

The sheath may be connected to a means of attachment at either end thereof. For instance, eyelets, thimbles, and other means may be spliced together, or be held by, the sheath. The core may, or may not, be directly attached to these means of attachment.

The sheath may be attached to the core at least in one place. This may be towards, or at, either extreme axial end of the sheath. The core may include a substantially annular groove on its outer surface and the limb may further comprise a binding for constricting the radial width of the sheath in the region of the groove thus restricting the relative movement of the core and sheath in this region. The limb may include one of these bound grooves towards, or at, either extreme end of the sheath.

In some embodiments, the sheath and the core may be unattached to one another such that, in use, the core may move relatively freely within the sheath. This means that the core carries no tensile load even when the limb is under tension. Rather, it is carried by the sheath. The core may still provide a radially directed force onto the sheath to urge the contraction in length of the sheath.

An advantage of such embodiments is that there may be less abrasion caused by the friction between the core and the sheath. However, in some embodiments, the mooring limb may further comprise one or more layers provided between the core and the sheath. For instance, one layer may be provided around the core. In the case of there being more than one core, one layer may be provided around them all, or one layer may be provided around each core, or a layer may be provided around each of at least one of the cores. The layer(s) may be bound to the surface of the core(s). In one embodiment, a layer may be provided within, and at least loosely bound to, the sheath. This may be in addition, or as an alternative, to the layer around the core. These layers may act as barriers to reduce, or eliminate, abrasion on either or both of the core and the sheath. At least one layer may have low frictional qualities such that it enables the sheath and core to move relative to one another with relative ease. This movement may be axially and/or circumferentially. The layers may be manufactured from HDPE, or another polymer with high abrasion resistance. The layers may comprise a relatively fine weave of polymer strands or yarns. The layers may be pervious/porous. The layers may comprise a homogenous film with or without perforations. The layers may remain substantially stationary relative to either the sheath or the core. The layers may act as a marine growth barrier layer to prevent or reduce fouling.

The core may be substantially inextensible. However, the core may still be compressible. An example of a material that may have these two characteristics is cork due to its porosity.

The mooring limb may comprise more than one core. For instance, there may be more than one section of core arranged axially along the length of the limb such that there is only one core at any axial point. For instance, the cores may be aligned axially along the longitudinal axis of the limb. In this example, spaces may be provided axially between the individual cores. One possibility is that the limb comprises more than one substantially spherical (or ovoid shape) core spaced along its length. Alternatively, there may be more than one core at any axial point such as a bundle of cores. For instance, the cores may be aligned radially relative to one another along the longitudinal axis of the limb. These bundles of one or more cores may also be separated by axial spaces therebetween. The various cores may have different characteristics, such as material type, size, density, shape etc. A mix of one core and bundles of cores may be provided.

The mooring limb may be a damping mooring limb for damping oscillations induced in the limb, and/or the object to which it is attached, in use.

The sheath may be resilient in a radial and/or axial direction.

It is possible that no more than 50% of a limb's maximum tensile load is carried, in use, by the core. This may be no more than 40%, or no more than 30%, or no more than 20%, or even no more than 10%. In this manner, the core may extend due to tensile or compressive forces acting on it but may not provide a majority of the tensile strength of the limb overall. Rather, the majority of the tensile load may be carried by the sheath. In this regard, the characteristics of the core may be selectable to provide a limb having the required characteristics. Furthermore, when tensile load is carried by the core, the Young's modulus of the core may be less than 3 Mpa, or less than 2.5 Mpa, or less than 2 Mpa. The core may contract diametrically according to the relevant Poisson's ratio for its constituent material.

In yielding to the pressure exerted on it, the core may contract diametrically to allow extension of the limb. On contraction of the axial length of the limb and expansion of the radial size of the core, energy may be dissipated such that only a fraction of the energy is returned to the system. This hysteretic damping and the fraction of energy lost in each cycle is the hysteretic damping ratio. The hysteretic damping ratio may be substantially higher than that for an elastic member comprising natural rubber and may be substantially equal to, or greater than 0.5.

In a second aspect, the invention provides a method of mooring an object substantially floating in a fluid using at least one mooring limb according to the first aspect, and/or as described, and/or claimed herein, comprising the steps of; directly or indirectly attaching one axial end of the device to the object and directly or indirectly attaching the other axial end to a substantially fixed object.

The method may include the step of providing a movable fixing point provided between the two axial ends of the mooring limb. For instance, if such a movable fixing point was provided on the surface under the water then the effective length of the limb may be reduced as required. This may be useful in situations where the height of the fluid level may reduce in use to less than the effective length of the limb. In other words, the movable fixing point may be said to take up the slack in the limb. An example of such a movable fixing point is a sliding anchor or pulley.

In a third aspect, the invention provides a method of making a mooring limb comprising the steps of determining the required length, extension properties, tensile strength and damping frequency response of the limb, selecting the appropriate size, quantity and type of materials to fulfill such requirements and arranging the materials to provide a mooring limb according to the first aspect, and/or as described, and/or claimed herein.

The oscillation of the object, to which the limb is attached, may be caused by more than one factor such as waves and tides. Each factor may have a different frequency. The overall frequency of the oscillation of the object may thus be a result of the combination of the various factors. The mooring limb may be tuned (by selection of materials, size, quantity etc.) to damp an individual frequency of one of the factors, or to damp the resultant frequency on the mooring limb, and/or the object to which it is attached, or any other frequency as required.

In this way, the rate at which the shape, and thus the length, of the limb changes may be controllable. For example, it may be slowed such that the length of the limb increases and/or decreases, and thus its shape changes, at a controlled rate. In this way, the frequency of the oscillations induced in the limb, and/or object to which it is attached, may be controllably damped.

As the forces acting on the limb may also vary non-linearly due to the oscillations induced in the system the limb may be tuned so as to be more, or less, effective at damping those oscillations.

Although the mooring limb is described herein in terms of water type fluids it should be understood that the invention also contemplates other uses such as airborne mooring.

It is possible that a mooring limb having some of the features described and/or claimed herein could comprise a sheath and a core arranged separately from one another.

The mooring limb may have a longitudinal axis and a radial axis, wherein the longitudinal length measured along the longitudinal axis may be substantially greater than the radial width measured along the radial axis. Alternatively, the limb may be substantially spherical, oval, or any other shape. The shape may be due to the shape of the core.

The sheath may be gathered at each longitudinal end such that the radial width reduces at each end.

It is possible that the sheath is integral with the core. The sheath may be linked to the one or more cores in some way so that the change in its length and diameter directly influence the change in the length and diameter of the core. For instance, some of the braids may pass through loops or straps provided on the outer surface of the core so as to help pull, or push, the sheath back into shape as it contracts axially, in use.

The resilience of the sheath may urge the limb to retain a defined shape such that when the shape is changed due to a force provided on it by the moored object the sheath urges the limb to regain its original shape.

The rate of change of the shape of the limb may be non-linear. This non-linearity may be controllable by varying certain qualities of the sheath and the core, such as the types of materials and its shape. This non-linearity may be exploited so as to provide an additional way of tuning the limb to damp induced oscillations.

The limb according to the invention may be only a relatively short length of the overall mooring limb. For instance, the overall mooring limb may comprise a mooring limb according to the invention, attached to the land beneath the fluid (or shore) at one end, and to the object to be moored at the other end, by means of chains, ropes or wires, wherein the combined lengths of the chains, ropes or wires are much longer than the length of the limb according to the invention. In this regard, the mooring limb according to the invention may be called a "mooring component".

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
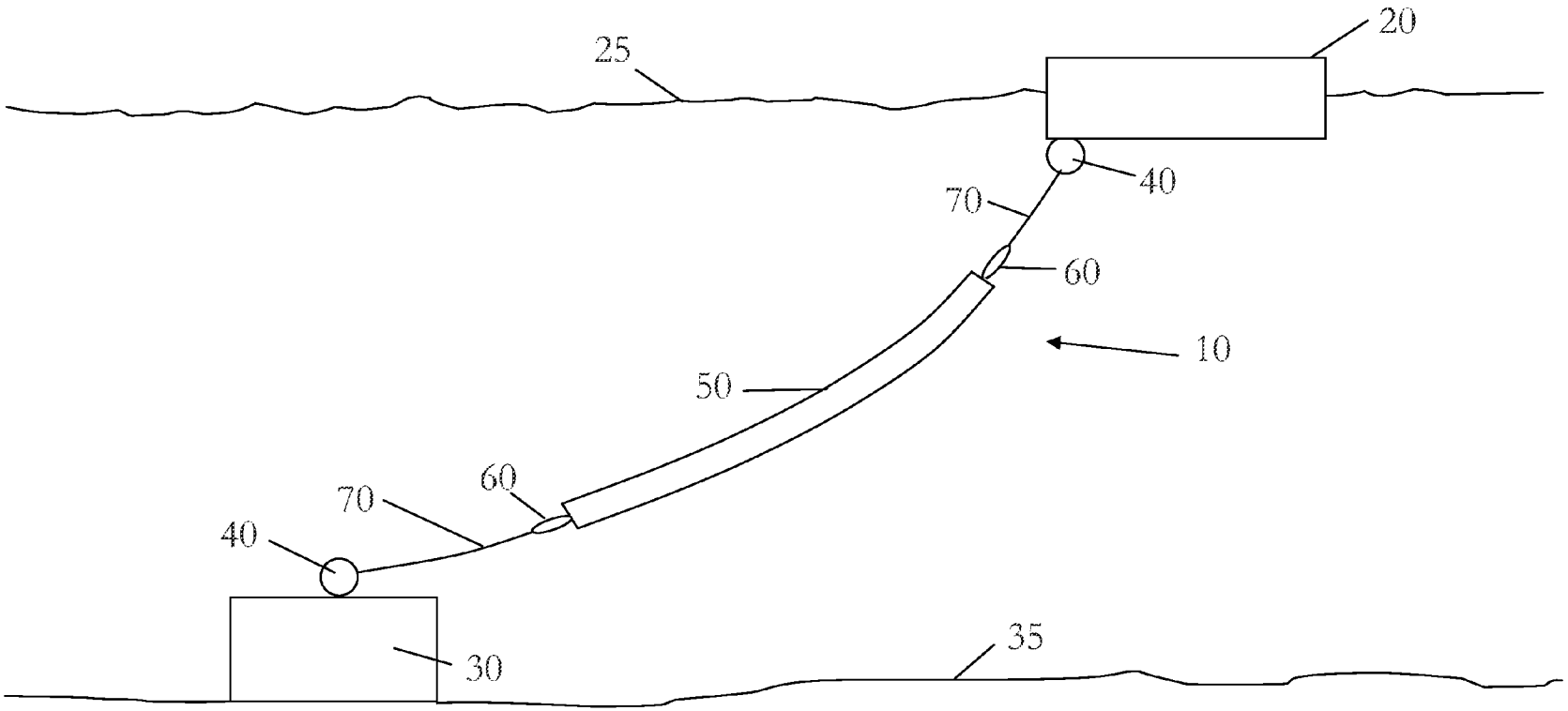
FIG. 1 is an elevational side view of a general arrangement of one embodiment of the invention in use.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a member A connected to a member B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may refer to different embodiments. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

In FIG. 1 the mooring limb is referenced "10". It is shown mooring an object 20, which is floating at the surface 25 of a body of fluid, to a fixed point 30, which in this case is a concrete block resting on the land surface (sea bed) 35 beneath the fluid. The fixed point 30 and the object 20 include anchor points 40 between which the limb is arranged.

The limb 10 itself comprises an outer braided cylindrical sheath 50 at each end of which are arranged connectors 60, which are simple loops in the present case. Standard chains or ropes 70 are used to connect the anchor points 40 to the connectors 60. Although the length of the limb 10 is shown as approximately equal in length to the sum of the two lengths of chains or ropes 70, it might be substantially less or more than this summed length such that it forms either a relatively short or long part of the overall length of the mooring member (comprising the limb 10 and chains or ropes 70).

Although only one limb 10 is shown it is contemplated that more than one may be used with the same floating object 20 and the same, or one or more other, fixed points 30 such that the object 20 is maintained "on station".

Figure 2:
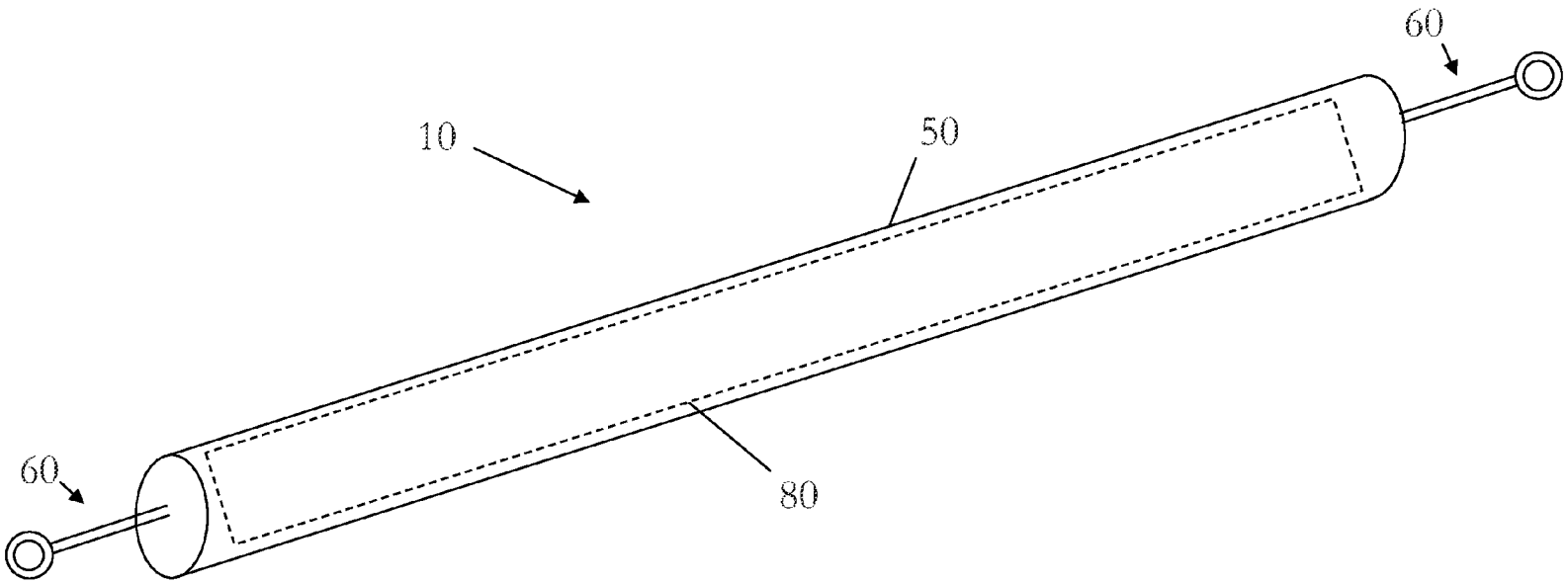
FIG. 2 is a perspective view of the embodiment of FIG. 1.

One embodiment of the limb 10 is shown in more detail in FIG. 2. It comprises the sheath 50 and an inner elastically compressible core 80. This core 80 is also substantially cylindrical and resides radially within the sheath 50. In this example, the core 80 is not connected to the sheath 50 in that it may move axially within the sheath 50 and does not carry any tensile load exerted on the limb 10.

The limb 10 also includes connectors 60 provided at each longitudinal end thereof. These connectors 60 comprise relatively short lengths of rope, chain, cable etc. attached at one end to the limb 10 and having loops or shackles at the other end.

Figure 3:
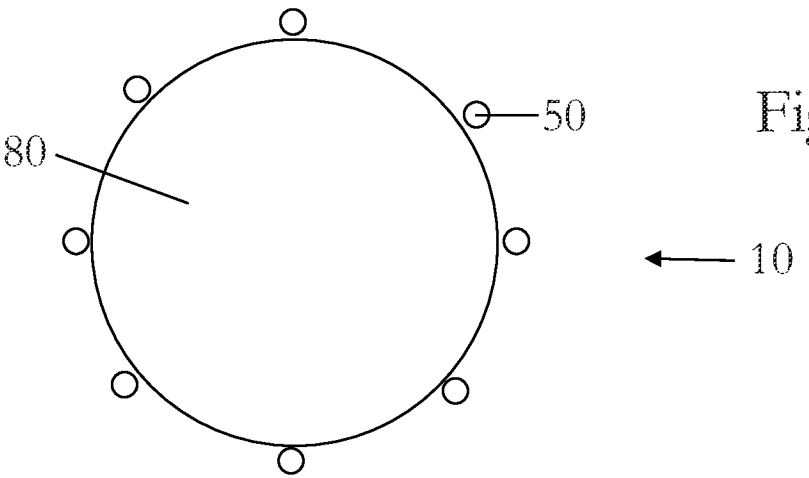
FIG. 3 is a radial cross-sectional view of the embodiment of FIG. 1 having a first longitudinal length.

A radial cross-sectional view is depicted in FIG. 3. This is a view of a radial cross-section looking along the longitudinal axis of the limb 10. The sheath 50 is referenced 50. It lies radially outwardly of the inner core 80. In this example, the sheath 50 lies substantially on the outer surface of the core 80. The sheath 50 comprises a series of braids. This takes the form of a criss-cross arrangement of wires, or cords, which lie circumferentially around the sheath 50 and at two different angles to the radial plane of the limb 10. A first set of wires, or cords, are arranged at one angle (approximately 45 degrees clockwise from the radial plane) and a second set are arranged at another angle (approximately 45 degrees anticlockwise from the radial plane).

A total of eight wires, or cords, are shown; however, it is understood that the sheath may comprise more or less than eight at any point along the axial length of the limb 10. Further, the number of wires, or cords, may vary axially.

Figure 4:
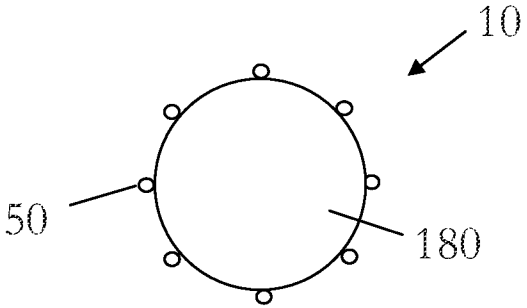
FIG. 4 is a radial cross-sectional view of the embodiment of FIG. 1 having a second longitudinal length.

As the axial length of the limb 10 is increased, due to a tensile force acting thereon, the sheath is extended axially. Due to the braiding, the radius of the sheath 50 contracts providing a squeezing, radially and inwardly directed, force. This force will act upon the core 80 and reduce its diameter. The core may resist the radial force exerted on it by the sheath 50. A cross-section through the limb of FIG. 3 is shown in FIG. 4. It may be seen that the radius of the limb 10 has decreased along with the radius of the core 80 and sheath 50.

When the tensile load on the limb 10 is reduced, the elastic nature of the core 80 imparts a radially and outwardly directed force onto the sheath 50. This moves the braids in the sheath 50 back towards their natural relaxed state (shown in FIG. 3). This radially outward movement of the braids contracts the axial length of the limb 10. In this and other examples, it is the elastic nature of the core 80 providing a radial force that contracts the length of the limb 10 and not its axial elastic properties.

Figure 5:
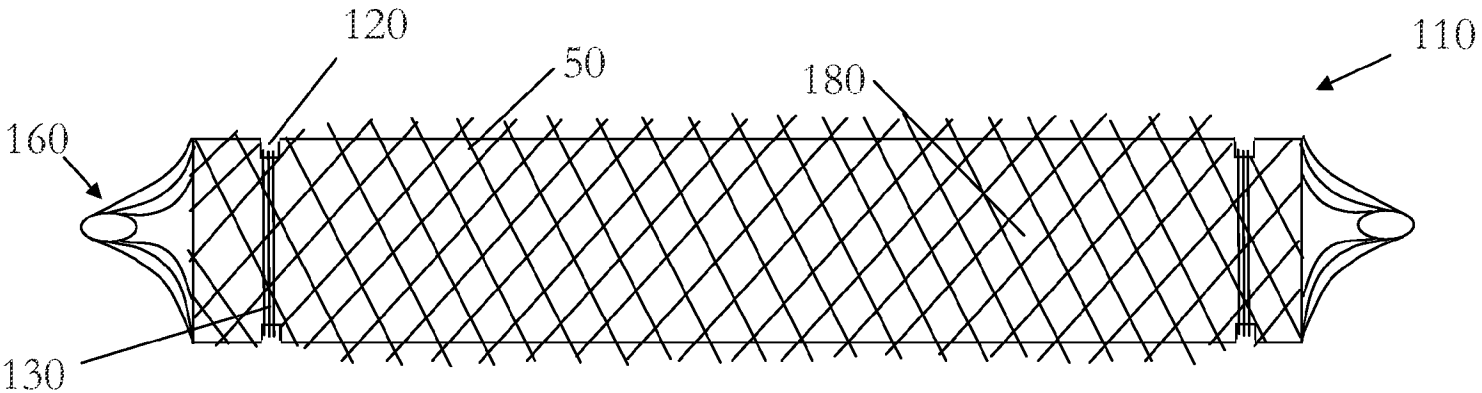
FIG. 5 is a longitudinal cross-sectional view of another embodiment having a first longitudinal length.

The view in FIG. 5 is one of a different limb 110 in a relaxed state having an original unstressed and unchanged shape. The sheath 50 is bound to the core 180 at either end of the limb 110. This is affected by an annular groove which extends circumferentially about the perimeter of the core 180 towards each axial end of the limb 110. The sheath 50 in these two regions is drawn radially inward into each groove and held in place by bindings 130. This allows the core 180 and sheath 50 to be fixed relative to one another in these regions but may allow them to move relative to one another, if necessary, at other axial points along the length of the limb 110.

The connection means 160 comprise a thimble which is a metal eyelet bound or spliced into the sheath 50. In this way the tensile load existent on the limb 110 is carried mostly by the sheath 50 although some will be carried by the core 180. Other connection means such as including ferrules are possible.

Figure 6:
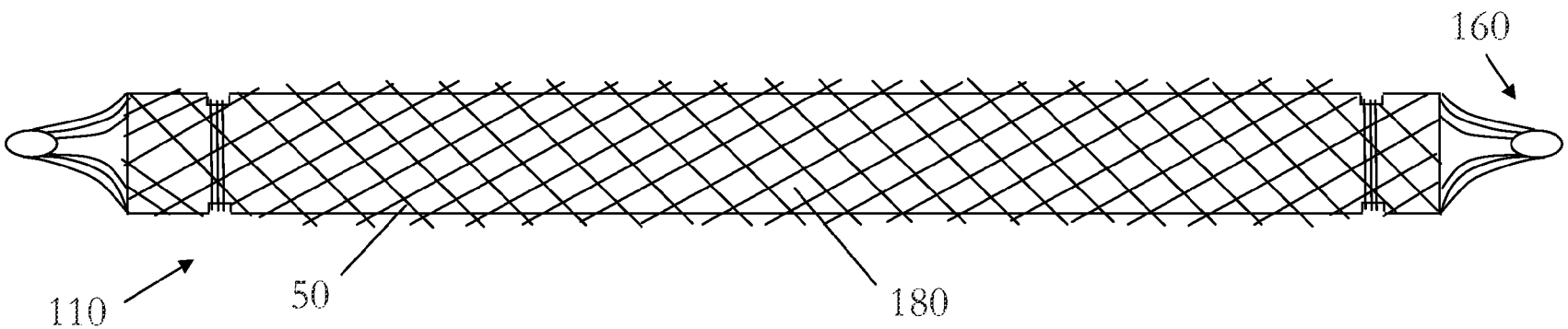
FIG. 6 is a longitudinal cross-sectional view of the embodiment of FIG. 5 having a second longitudinal length.

In FIG. 6, the same limb 110 is shown; however, its longitudinal length has increased as a tensile load is exerted on it. It will be seen that the radial width of the limb 110 has contracted. This is due to the sheath 50 contracting due to the nature of the braiding. This exerts a force onto the inner core 180 which is thus compressed, and in this example, axially extended.

When the tensile load on the sheath 50 is reduced, the core 180 provides a radially outwardly directed force onto the sheath as described above in relation to FIGS. 3 and 4. This moves the braids of the sheath 50 back towards their relaxed state as shown in FIG. 5 wherein the cross-sectional radius of the sheath 50 is greater than the cross-sectional radius of the sheath 50 when extended axially as shown in FIG. 6. Although the core 180 is connected to the sheath 50 this may be for the purpose of reducing relative axial movement between the core 180 and the sheath 50 to reduce or eliminate abrasion caused by this relative movement and may not necessarily be for providing an axial force on the limb.

Figure 7:
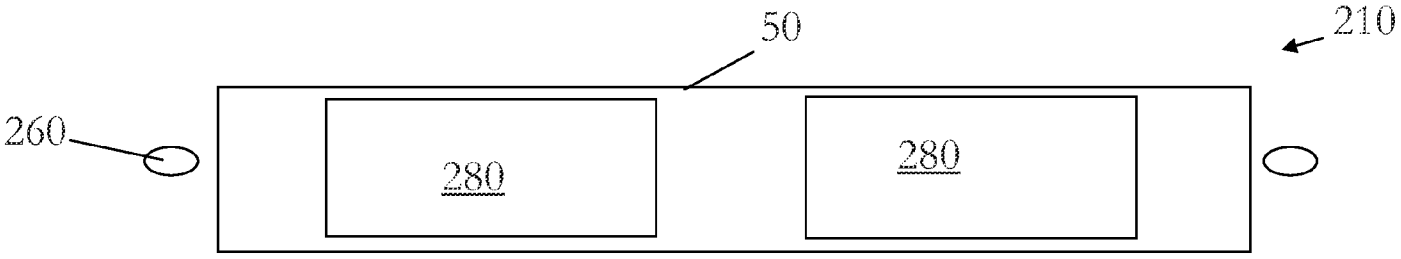
FIG. 7 is a longitudinal cross-sectional view of yet another embodiment having a first longitudinal length.

In FIG. 7 an embodiment is shown which has a sheath 50 and two inner cores 280. These cores 280 are substantially the same size as each other but are not connected to one another or to the sheath, although this is possible. Connection means for connecting the limb 210 to objects for mooring are indicated by ovals 260 at either axial end of the limb 210.

Figure 8:
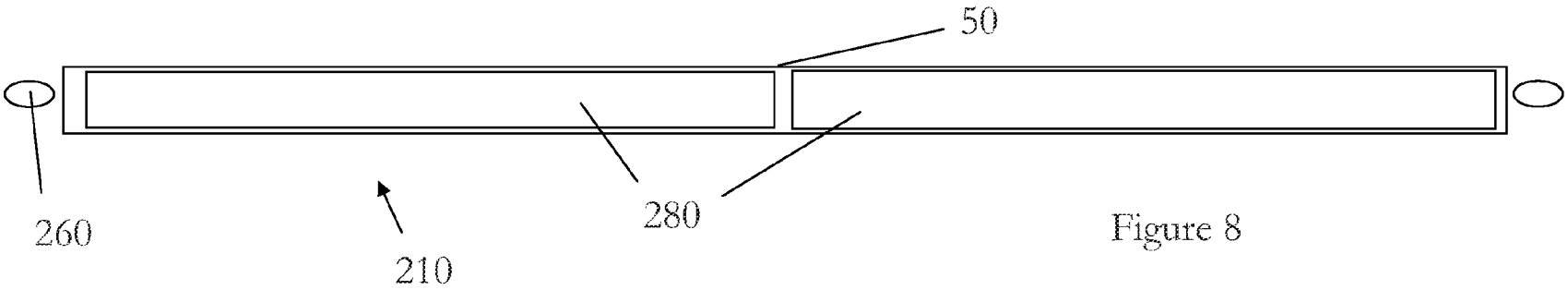
FIG. 8 is a longitudinal cross-sectional view of the embodiment of FIG. 7 having a second longitudinal length.

As a tensile load is imparted onto the limb 210 it extends axially and the radial dimension of the limb 210 contracts. This may squeeze the cores 280 such that they extend longitudinally/axially and contract radially. In this example, as shown in FIG. 8, the two cores 280 move towards one another. However, it is possible that with selected materials, dimensions and spacing of the cores 280 they would move apart from one another such that the gap therebetween increases (not shown).

As the tensile force on the limb 210 is reduced the limb 210 will return towards its state shown in FIG. 7 by means of the cores 280 imparting a radial outwardly directed force onto the sheath 50 thus contracting it axially.

Figure 9:
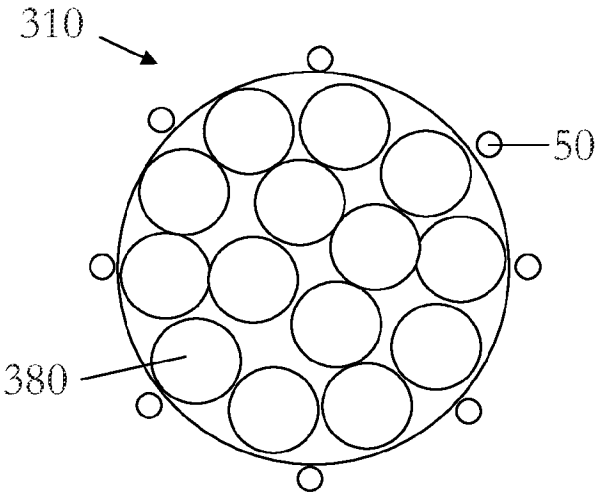
FIG. 9 is a radial cross-sectional view of a different embodiment of the invention.

It is possible that the limb 310 may include more than one core at any axial point as shown in FIG. 9 which is a cross-section of a limb 310 having fourteen separate cores 380 each being a substantially cylindrical member of elastically compressible material. In some embodiments, some of the cores 380 may have differing Young's modulus values from some of the others, or may be of different materials, or of different sizes. Moreover, one or more of these cores may be attached to one another.

Figure 10:
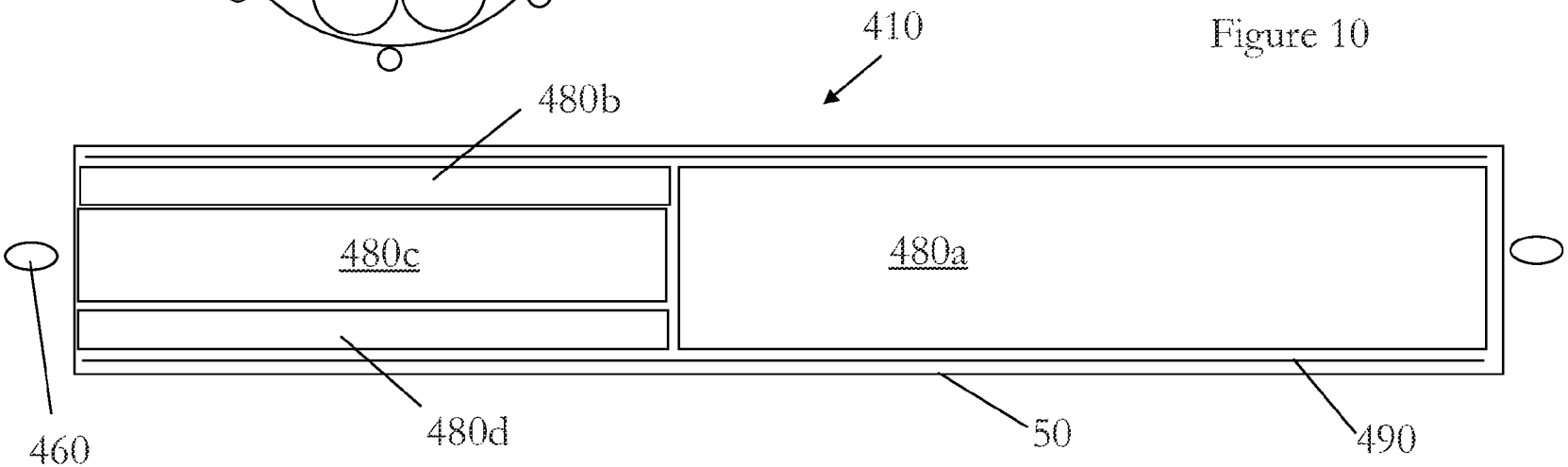
FIG. 10 is a longitudinal cross-sectional view of a further embodiment of the invention.

Another possibility is that shown in FIG. 10 where the limb 410 comprises a sheath 50 and a core 480*a* which substantially fills the sheath 50 at one axial end of the limb 410. At the other axial end of the limb 410 three separate cores 480*b*, 480*c*, 480*d* are arranged. The cores 480*b*, 480*c*, 480*d* are of differing sizes and lengths compared to one another and to the core 480*a*. The cores 480*a*, 480*b*, 480*c*, 480*d* may or may not be connected to one another and/or to the sheath. An intermediate layer 490 is arranged radially between the cores 480*a*, 480*b*, 480*c*, 480*d* and the sheath 50. This may act to reduce or avoid abrasion of the cores and/or sheath caused by them rubbing against one another in use. More than one intermediate layer 490 may be included, and one or more of these layers 490 may be at least partially adhered to either one of the sheath and cores. Connection means for connecting the limb 410 to objects for the purpose of mooring them are indicated generally by ovals referenced 460.

Figure 11:
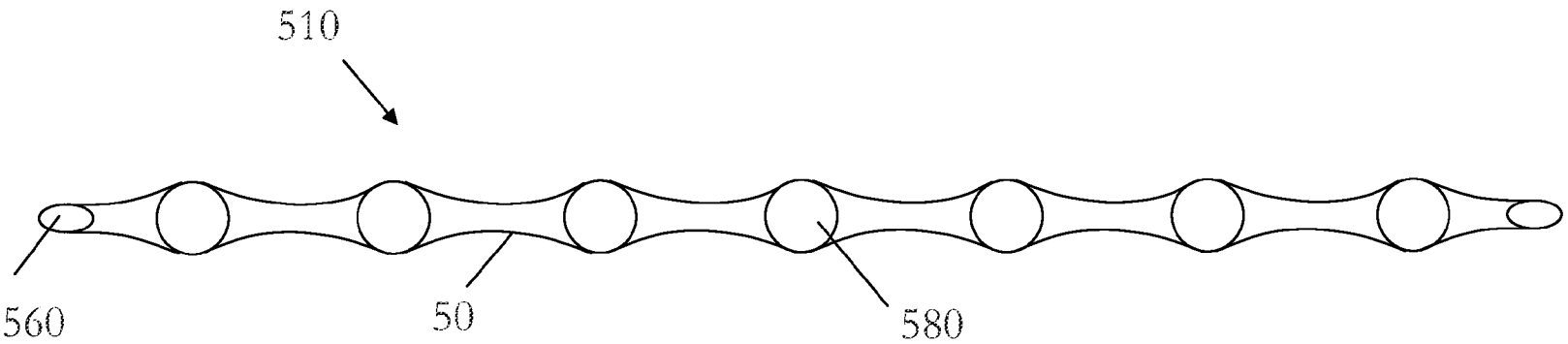
FIG. 11 is a longitudinal cross-sectional view of a yet further embodiment of the invention.

A different embodiment is shown in FIG. 11 where the limb 510 comprises a sheath 50 and a plurality of substantially spherical shape cores 580 spaced apart along the length of the limb 510. Connection means for connecting the limb 510 to objects for the purpose of mooring them are indicated generally by ovals referenced 560. The figure shows a limb 510 in a longitudinally extended state. Accordingly, the radius, or width, of the sheath 50 has contracted and between the cores 580 is smaller than that at the cores 580. In fact, the sheath 50 "necks" or bows inwardly between the cores 580. This difference in dimension is because the cores 580 prevent the sheath 50 from having a uniform radius, or width, along its entire longitudinal length. In this way, a force is provided radially inward onto the cores 580 by the sheath 50. Compression of the cores 580 may then be effected.

The overall longitudinal length of the limb may lie in the range 1 meter to 100 meters. The radial dimension of the limb may lie in the range 2 cm to 100 cm.

The invention claimed is:

1. A mooring limb comprising more than one elastically compressible core and an outer sheath, the more than one elastically compressible core being arranged with radial and/or axial spaces therebetween in an initial state, the limb being axially extensible as a result of a tensile force being applied to the sheath, the radial width of the sheath being contractible as the axial length of the limb increases, the cores being compressible radially by the sheath as the axial length of the limb increases and the sheath radially contracts around the cores, the initial spaces between the cores being reduced by the radial force acting upon the cores by the radial contraction of the sheath, the limb being axially contractible as a result of a force provided by the cores acting radially outward onto the sheath; the limb further comprising at least one layer provided between the cores and the sheath wherein the at least one layer has relatively low frictional properties to enable the sheath and cores to move relative to one another with relative ease.

2. The mooring limb of claim 1, wherein the sheath is resilient in a radial and/or axial direction.

3. The mooring limb of claim 1, wherein no more than 10% of a limb's maximum acceptable tensile load is carried, in use, by the cores.

4. The mooring limb of claim 1, wherein when a tensile load is carried by the cores, the Young's modulus of the core material is less than 3 Mpa.

5. The mooring limb of claim 1, wherein when a tensile load is carried by the cores the Young's modulus of the core material is less than 2.5 Mpa.

6. The mooring limb of claim 1, wherein when a tensile load is carried by the cores, the Young's modulus of the core material is less than 2 Mpa.

7. A mooring limb comprising more than one elastically compressible core and an outer sheath, the more than one elastically compressible core being arranged with radial and/or axial spaces therebetween in an initial state, the limb being axially extensible as a result of a tensile force being applied to the sheath, the radial width of the sheath being contractible as the axial length of the limb increases, the cores being compressible radially by the sheath as the axial length of the limb increases and the sheath radially contracts around the cores, the initial spaces between the cores being reduced by the radial force acting upon the cores by the radial contraction of the sheath, the limb being axially contractible as a result of a force provided by the cores acting radially outward onto the sheath; the limb further comprising at least one layer provided between the cores and the sheath wherein the at least one layer remains substantially stationary relative to either the sheath or the cores.

8. The mooring limb of claim 7, wherein the sheath and the cores are unattached to one another such that, in use, the cores may move relatively freely within the sheath.

9. The mooring limb of claim 7, wherein the sheath is resilient in a radial and/or axial direction.

10. The mooring limb of claim 7, wherein no more than 10% of a limb's maximum acceptable tensile load is carried, in use, by the cores.

11. The mooring limb of claim 7, wherein when a tensile load is carried by the cores, the Young's modulus of the core material is less than 3 Mpa.

12. The mooring limb of claim 7, wherein when a tensile load is carried by the cores, the Young's modulus of the core material is less than 2.5 Mpa.

13. The mooring limb of claim 7, wherein when a tensile load is carried by the cores, the Young's modulus of the core material is less than 2 Mpa.

14. A mooring limb comprising more than one elastically compressible core and an outer sheath, the more than one elastically compressible core being arranged with radial and/or axial spaces therebetween in an initial state, the limb being axially extensible as a result of a tensile force being applied to the sheath, the radial width of the sheath being contractible as the axial length of the limb increases, the cores being compressible radially by the sheath as the axial length of the limb increases and the sheath radially contracts around the cores, the initial spaces between the cores being reduced by the radial force acting upon the cores by the radial contraction of the sheath, the limb being axially contractible as a result of a force provided by the cores acting radially outward onto the sheath; wherein the sheath is attached to the cores at least in one place and a core includes a substantially annular groove on its outer surface and the limb further comprises a binding for constricting the radial width of the sheath in the region of the groove thus restricting the relative movement of the core and sheath in this region.

15. The mooring limb of claim 14, wherein the sheath is resilient in a radial and/or axial direction.

16. The mooring limb of claim 14, wherein no more than 10% of a limb's maximum acceptable tensile load is carried, in use, by the cores.

17. The mooring limb of claim 14, wherein when a tensile load is carried by the cores, the Young's modulus of the core material is less than 3 Mpa.

18. The mooring limb of claim 14, wherein when a tensile load is carried by the cores, the Young's modulus of the core material is less than 2.5 Mpa.

19. The mooring limb of claim 14, wherein when a tensile load is carried by the cores, the Young's modulus of the core material is less than 2 Mpa.

* * * * *